US008695295B2

(12) United States Patent
Thornton et al.

(10) Patent No.: US 8,695,295 B2
(45) Date of Patent: Apr. 15, 2014

(54) TIMBER STRUCTURAL MEMBER

(76) Inventors: Patrick Thornton, Oak Flats (AU); Peter Blair, Willoughby (AU)

( * ) Notice: Subject to any disclaimer, the term of this patent is extended or adjusted under 35 U.S.C. 154(b) by 0 days.

(21) Appl. No.: 13/128,399

(22) PCT Filed: Nov. 9, 2009

(86) PCT No.: PCT/AU2009/001453
§ 371 (c)(1),
(2), (4) Date: Aug. 8, 2011

(87) PCT Pub. No.: WO2010/057243
PCT Pub. Date: May 27, 2010

(65) Prior Publication Data

US 2011/0283639 A1 Nov. 24, 2011

(30) Foreign Application Priority Data

Nov. 18, 2008 (AU) ..... 2008905928
Aug. 5, 2009 (AU) ..... 2009903659

(51) Int. Cl.
*E04B 1/10* (2006.01)

(52) U.S. Cl.
USPC ..... 52/233; 52/285.4; 446/106

(58) Field of Classification Search
USPC ..... 52/233, 286, 285.4, 592.5, 592.6, 604, 52/605; 446/106
See application file for complete search history.

(56) References Cited

U.S. PATENT DOCUMENTS

| | | | | | |
|---|---|---|---|---|---|
| 682,312 | A * | 9/1901 | Zwicker | 52/285.4 |
| 2,613,708 | A * | 10/1952 | Blackmore | 144/345 |
| 3,517,471 | A * | 6/1970 | Lindmark | 52/233 |
| 4,096,674 | A * | 6/1978 | Kollar et al. | 52/233 |
| 4,463,532 | A * | 8/1984 | Faw | 52/233 |
| 4,688,362 | A * | 8/1987 | Pedersen et al. | 52/223.7 |
| 4,863,305 | A * | 9/1989 | Schold | 403/171 |
| 5,058,343 | A * | 10/1991 | Nipko | 52/233 |
| 5,283,994 | A * | 2/1994 | Callison | 52/71 |
| RE35,327 | E * | 9/1996 | Sing | 52/309.9 |
| 5,618,371 | A * | 4/1997 | Sing | 156/264 |
| 5,787,675 | A * | 8/1998 | Futagi | 52/745.1 |
| 5,896,723 | A * | 4/1999 | Sing | 52/847 |
| 6,071,044 | A * | 6/2000 | Ricciardelli et al. | 405/286 |
| 6,200,061 | B1 * | 3/2001 | Goto | 403/268 |
| 7,797,896 | B2 * | 9/2010 | Miller et al. | 52/233 |
| 2002/0170257 | A1 * | 11/2002 | McLain et al. | 52/539 |

* cited by examiner

*Primary Examiner* — Adriana Figueroa
(74) *Attorney, Agent, or Firm* — Birch, Stewart, Kolasch & Birch, LLP

(57) ABSTRACT

A timber structural member is provided. The structural member includes a first timber round having a first cooperating surface extending longitudinally along the length thereof, and a second timber round having a second cooperating surface extending longitudinally along the length thereof. The first cooperating surface is shaped to cooperate with the second cooperating surface and the two timber rounds are secured together to form a structurally integral unit in which the first cooperating surface is in contact with the second cooperating surface and the first timber round is substantially parallel to the second timber round. The first timber round is secured to the second timber round by a plurality of fasteners spaced along the length of the member, the plurality of fasteners including fasteners provided at both acute and obtuse angles from a longitudinal axis of the structural member.

16 Claims, 8 Drawing Sheets

TIMBER STRUCTURAL MEMBER

This application is the national stage of International Application No. PCT/AU2009/001453 filed on Nov. 9, 2009, which claims priority under 35 USC §119(a)-(d) of Application No. 2008905928 filed in Australia on Nov. 18, 2008 and Application No. 2009903659 filed in Australia on Aug. 5, 2009.

FIELD OF THE INVENTION

The present invention relates to structural members for use in building construction.

BACKGROUND OF THE INVENTION

Timber structural members play an important part in the construction of building structures. Due to its strengths for load bearing and its natural ability to withstand a variety of forces, timber is commonly used for a variety of structures and sub-structures such as, for example, joists, beams, columns, rafters and frames. Further, when compared to metal based materials timber structural members are often less costly and are more easily cut and processed for specific building requirements.

There are, however, a number of disadvantages and complications associated with timber structural members. Any imperfection in a timber can compromise the strength of the member and, consequently, any structure built using that member. Accordingly, relatively high quality lumber is required for the manufacture of timber members (which include, for example, timber joists). This places a large demand on particular species of trees that are of specific age and quality, which in turn leads to increased cost in production as well as raising natural resource conservation issues. Depending on the part of the log solid timber is sawn from, the timber may have deficiencies or issues with splinters, rotting, knots, abnormal growth and grain structures. Additionally, when sawn and prepared for commercial use the lumbers are prone to processing defects such as chipping, torn grain and timber wanes.

Furthermore, using solid timber has the added difficulty that timber with appropriate dimensions and strength to weight ratio for a required application must be found. As will be appreciated, this is dependent on being able to find the appropriately sized and shaped tree from which the timber will be cut.

To address the problems associated with solid wood lumber, alternative forms of wood material for making timber joists have been sought. These include engineered wood composites such as plywood, laminated veneer lumber ("LVL"), oriented strand lumber ("OSL") and oriented strand board ("OSB"). Wood composites have the advantage of being less expensive in raw material cost (as they are able to be formed from lower grade wood or even wood wastes) and do not have the problems associated with solid lumber defects. However, the energy and resource requirements in the manufacture of engineered wood composites are generally higher as processed structural timber requires more cutting, bonding and curing than naturally formed timber.

Timber joists made from wood composites are also problematic with respect to joining. They are usually joined by bearing onto another member and are nailed to deter sideway twisting and/or movement. For the joists to be able to withstand both axial compression and transverse bending, for example when used as beam/columns, additional torsion restraints are required such as noggins or end blockings. These torsion restraints can become design hindrances, for example when mounted metal braces are used. Additionally, metal braces are prone to oxidation and collapse in fire as their strength decreases significantly at elevated temperatures.

Accordingly, it would be desirable to provide a timber structural member that ameliorates or overcomes one or more of the above deficiencies or at least provides a useful alternative.

Reference to any prior art in the specification is not, and should not be taken as, an acknowledgment or any form of suggestion that this prior art forms part of the common general knowledge in Australia or any other jurisdiction or that this prior art could reasonably be expected to be ascertained, understood and regarded as relevant by a person skilled in the art.

SUMMARY OF THE INVENTION

In one aspect the present invention provides a timber structural member including: a first timber round having a first cooperating surface extending longitudinally along the length thereof, and a second timber round having a second cooperating surface extending longitudinally along the length thereof, wherein the first cooperating surface is shaped to cooperate with the second cooperating surface and the two timber rounds are secured together to form a structurally integral unit in which the first cooperating surface is in contact with the second cooperating surface and the first timber round is substantially parallel to the second timber round, and wherein the first timber round is secured to the second timber round by a plurality of fasteners spaced along the length of the member, the plurality of fasteners including fasteners provided at both acute and obtuse angles from a longitudinal axis of the structural member.

The plurality of fasteners may include adjacent fasteners provided at alternating acute and obtuse angles from the longitudinal axis of the structural member.

The first cooperating surface may be a flat surface provided by removing a minor segment along the length of the first timber round, and the second cooperating surface may be a flat surface provided by removing a minor segment along the length of the second timber round.

The structural member may be provided with a plurality of holes passing through the first and second rounds, each hole shaped to receive one of the plurality of fasteners.

The plurality of holes may include holes formed at an acute angle to the longitudinal axis of the structural member and holes formed at an obtuse angle to the longitudinal axis of the structural member.

The holes formed at an acute angle may include holes formed at an angle of between 45° and 70° to the longitudinal axis of the structural member, and the holes formed at an obtuse angle may include holes formed at an angle of between 110° and 135° to the longitudinal axis of the structural member.

The holes formed at an acute angle may include holes formed at an angle of 60° to the longitudinal axis of the structural member, and the holes formed at an obtuse angle may include holes formed at an angle of 120° to the longitudinal axis of the structural member.

The fasteners may be secured in the holes by an adhesive.

The holes may be sized to allow sufficient clearance between their edges and the fasteners to allow each fastener to be encapsulated by the adhesive within the relevant hole.

The encapsulation of the fasteners by the adhesive may prevent the fasteners from contacting the sides of the holes in which they are located.

The ends of the fasteners may be provided with caps, the caps preventing exposure of the ends of the fasteners to the environment.

The fasteners may be reinforcement bars.

An end of the first timber round may be provided with a first radial cut and an end of the second timber round may be provided with a second radial cut, the ends of the first and second timber rounds being adjacent one another in the timber structural member, and the radial cuts shaped and positioned to allow the timber structural member to engage with a further member, the further member having a rounded cross-section.

The axes of the first and second radial cuts may be aligned.

The axes of the first and second radial cuts may be parallel.

The axes of the first and/or second radial cuts may be angled to allow the timber structural member to form an angled connection with the further timber round.

An end of the first timber round may be provided with a first axial bore sized to receive a first connecting dowel, and an end of the second timber round may be provided with a second axial bore sized to receive a second connecting dowel, the ends of the first and second timber rounds being adjacent one another in the timber structural member.

The first connecting dowel may be centrally positioned within the first bore to be coaxial with the first timber round, and the second connecting dowel is centrally positioned within the second bore to be coaxial with the second timber round.

The first and second connecting dowels may be centred respectively in the first and second bores by centring rings.

The connecting dowels may be selected from a group including a mild steel rod and a high strength steel rod.

The connecting dowels may be secured in the respective bores by an adhesive.

The bores may be sized to allow sufficient clearance between their edges and the relevant connecting dowel to allow the connecting dowel to be encapsulated by the adhesive within the relevant bore.

The first timber round may be secured to the second timber round by use of an adhesive applied to the first and/or second cooperating surfaces.

The present invention also extends to methods and apparatus for forming a timber structural member as described in the above statements.

As used herein, except where the context requires otherwise, the term "comprise" and variations of the term, such as "comprising", "comprises" and "comprised", are not intended to exclude further additives, components, integers or steps.

DETAILED DESCRIPTION OF THE EMBODIMENTS

Figure 1:
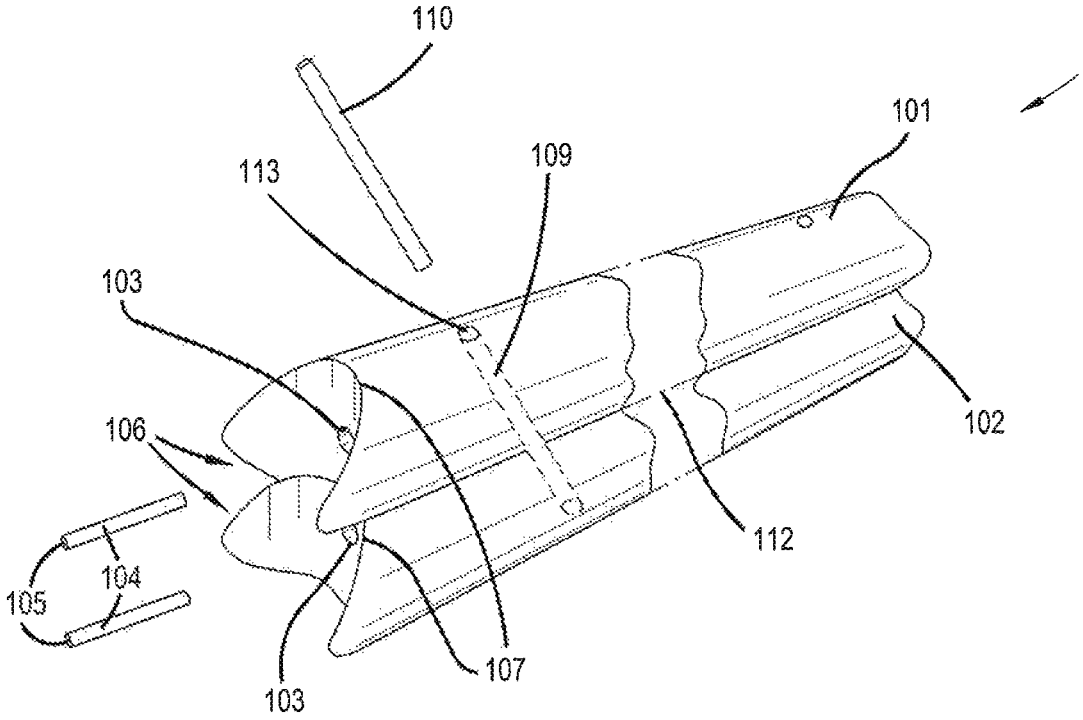
FIG. 1 shows a perspective view of a structural member in accordance with an embodiment of the present invention.

By way of general overview, and referring to FIG. 1, one embodiment of the present invention is a structural member 100 which is formed by securing a pair of true rounds 101 and 102 together. The preparation of the rounds, the manner in which they may be secured together, and some exemplary applications of the structural member are discussed in detail below.

1. Preparing the Base Materials

FIG. 1 provides a perspective view of a structural member 100 in accordance with an embodiment of the invention. Structural member 100 includes a first timber round 101 joined to a second timber round 102. The rounds 101 and 102 are each provided with a bearing surface (described below) and are joined along an interface 112 between these bearing surfaces.

The timbers used for the first and second timber rounds 101 and 102 are so-called "true round sections" or, as will be used herein, "true rounds" or "rounds". Rounds are described in Section 6 of Australian Standard 1720, and are typically produced from softwood trees grown commercially as renewable forest plantation timber. These timbers are typically fast growing, easily harvested, and have a low natural defect rate. Various species of timber are suitable to form the true rounds, particularly those types of species that tend to have a relatively constant diameter for a considerable portion of their length to minimise waste during the trimming and circularising processes. Plantation pine materials, such as slashpine or carribaea hybrids, tend to form suitable true rounds. Other materials that might be considered include Douglas fir, and various eucalypt species.

The processing of the timber into a true round is a simple process with the only waste being minor branches and bark section. Both of these "waste" materials can be simply and efficiently processed into materials servicing the landscape and construction industries. The energy involved in processing the true rounds is considerably less than that required for sawn sections.

By using whole sections the benefits of true rounds 101 and 102 (recognised in Australian Standard 1720) are inherited by the structural member 100. The intrinsic strength of whole sections of true rounds in comparison to equivalent sawn sections makes them ideal for use in the present invention. For example, true rounds have been selected for use because they provide a number of advantages over other timber products such as sawn timber or laminated timber products. One advantage, for example, is that true rounds are relatively inexpensive and are manufactured simply by cutting down a suitable diameter tree and then trimming the outer surface of the tree to form a pole with a constant diameter along its full length. Only waste material such as bark and branches are cut from the outer surface of the pole.

True rounds are particularly strong since the natural strength of the timber fibres is not disrupted by sawing or other treatment. The integrity of the round is maintained, and the trimming process required to circularise the round does not greatly affect the overall strength of the round. The natural characteristics of timber are that the central core or pith of the round is relatively soft and has low structural strength. The periphery of the timber, on the other hand, is much harder and the timber fibres are able to carry a high tensile load. Also, this hard outer layer is more resistant to water absorption and attack by insects, and thus by keeping the outer circumference of the timber largely intact in the process of preparing a true round, the structural integrity of the timber is maintained.

Figure 2C:
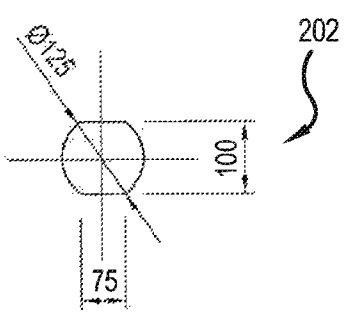
FIGS. 2A, 2B and 2C show sectional views of three alternative sized base timbers suitable for use in constructing a structural member in accordance with an embodiment of the present invention.
Figure 2B:
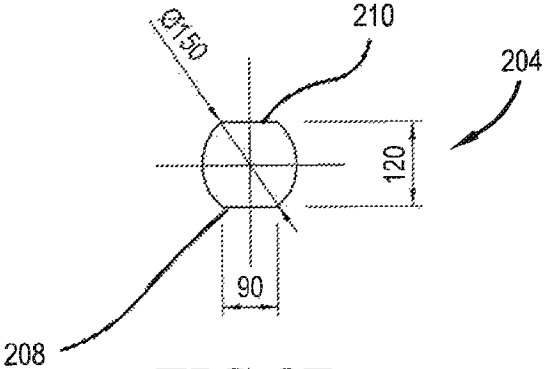
Figure 2A:
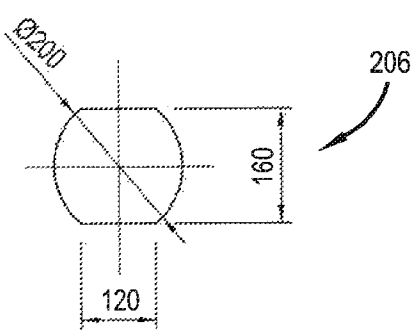

Referring to FIG. 2, three differently sized true rounds which may suitably be used in the present invention are shown: a round 202 with a 125 mm diameter, a round 204 with a 150 mm diameter, and a round 206 with a 200 mm diameter. Any diameter can, of course, be used but true rounds are typically in the range 75 mm-300 mm. The actual diameter selected will depend on the intended application of the structural member.

Figure 3C:
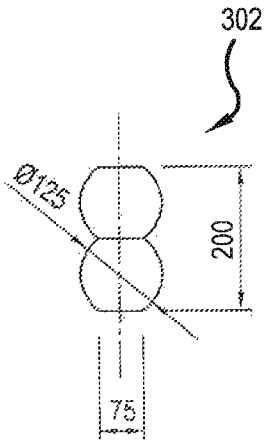
FIGS. 3A, 3B, and 3C show sectional view of the three base timbers shown in FIGS. 2A, 2B and 2C respectively, joined to create structural members in accordance with embodiments of the present invention.
Figure 3B:
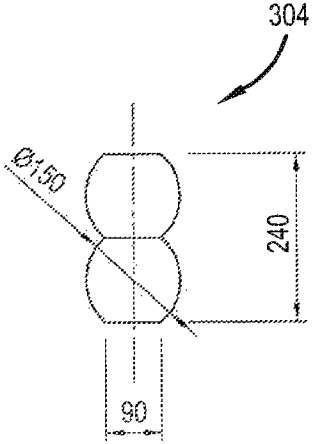
Figure 3A:
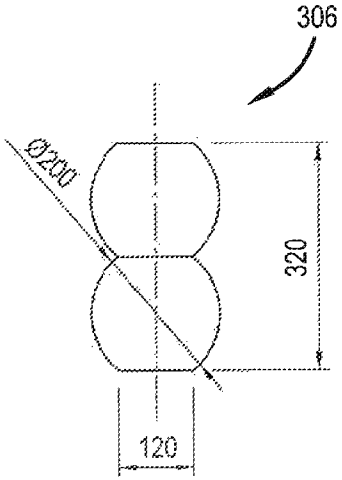

FIG. 3 shows end views of structural members 302, 304 and 306 that have been formed using the 125 mm round 202, the 150 mm round 204 and the 200 mm round 206 depicted in FIG. 2.

For the purposes of the present invention, the rounds are machined to remove a minor segment along the length of the round in order to provide a flattened bearing surface 208. The proportion of the flattened bearing surface 208 to the diameter of the round is selected to provide the structural member being manufactured (e.g. structural member 100) with a suitably sized cross section. For the present invention, a suitable minor segment size for removal is a segment with a depth of approximately 0.2 times the diameter of the round—i.e. for a 125 mm round a minor segment with a depth of approximately 25 mm is removed. The proportions can, of course, be altered depending on the particular structural application that may be required. The minor segment may be removed, for example, by using a ripping saw or a thicknesser.

In FIG. 2 the rounds 202, 204 and 206 are depicted as having being prepared with a pair of flattened bearing surfaces 208 and 210 on opposing sides of the round 202, 204 and 206. By providing two flattened bearing surfaces 208 and 210 on opposing sides of the round 202, 204 and 206 one of the bearing surfaces (e.g. 208) may be used in joining the round to another round to form a structural member (as described below) and the other (e.g. 210) may be used to provide a surface for fixing of other materials such as cladding elements to. Further, a symmetrical section with two segments removed is less likely to have unevenly distributed seasoning stresses.

Alternatively, however, and as per the structural member 100 shown in FIG. 1, the rounds could be prepared with a single flattened bearing surface 208 along which the rounds are joined.

Prior to joining the machined rounds 101 and 102 to create the structural member 100, the rounds 101 and 102 may be treated with a preservative to provide service life protection. Varying degrees of protection can be imparted dependent upon the intended application of the structural member 100—e.g. from H2 where the structural member is for use in above ground undercover applications to H5 where the structural member is used for in ground structural applications. A suitable preservative may be provided by employing the process known as Ammoniacal Copper Quaternary (ACQ) which is Chromium and Arsenic free.

2. Forming the Structural Member 2.1 Lamination

To form the structural member 100 the two rounds 101 and 102 which have been prepared with co-operating bearing surfaces (as described above) are matched and secured together. The rounds 101 and 102 are brought together using a jig, and the structural member 100 is laminated along the joining interface 112.

2.2 Cross-Doweling

Once the rounds 101 and 102 have been laminated, holes 109 are formed through the structural member 100, for example by drilling through the two rounds 101 and 102. Fasteners 110 are then inserted into the holes 109 and are fixed in place using an adhesive bonding material.

As will be appreciated, many alternative types of fasteners 110 may suitably be used, for example, pins, dowels, rods, or bolts. In this embodiment, however, the fasteners 110 used are deformed reinforcement bars as typically used in the concrete construction industry.

Alternative fasteners 110 include, for example, hot dipped galvanised deformed or Y-bar dowels, or any other dowel/rod/fastener with suitable strength properties for the requirements of the structural member and environmental conditions to which the structural member will be exposed. For example, and depending upon the proposed application of the structural member, fasteners of varying corrosion protection can be deployed. These may range from standard high tensile reinforcement bars (e.g. for inland non aggressive environments) to high grade stainless steel deformed bars (e.g. for aggressive marine environments).

The positions and angles of the holes 109 are selected to ensure that once fasteners 110 have been secured in place sufficient bonding occurs between the sections 101 and 102 to ensure true composite action of the structural member 100.

The diameters of the holes 109 and the dimensions of the fasteners 110 are selected in accordance with the intended application of the structural member 100. The holes 109 are sized to allow the fasteners 110 to fit with sufficient clearance as dictated by the performance properties of the adhesive bonding material being used. By way of example, typical hole to bar ratios may be as follows: a 22 mm hole for a 16 mm deformed bar; an 18 mm hole for a 12 mm bar; and a 30 mm hole for a 20 mm bar.

When securing the fasteners 110 in place in the holes 109 a preformed annular centring ring may be used to ensure the fastener 110 is centrally located in the hole 109. The centring ring (described below) allows the adhesive to flow through the ring into the hole 109 to ensure full encapsulation of the fastener 110 by the adhesive is achieved. The adhesive is injected around the dowel 110 from one end of the hole 109, the other end of the hole 109 allowing air to escape during the injection process. This ensures uniform distribution of the adhesive around the dowel 100 within the hole 109. The adhesive may be injected using, for example, a trigger cartridge gun or pneumatic cartridge gun. A washer 160 (described below) can also be used inside the hole 109 across the interface 112 between the two rounds 101 and 102 to stop any glue from escaping at the interface 112.

Once the members 101, 102, have been located in a jig the fasteners 110 are inserted into holes 109 and glue injection takes place. The rounds 101 and 102 are held in place whilst the adhesive achieves initial curing. This typically occurs within 4 hours but is dependent upon a number of variables including temperature, moisture content of the timber and glue formulation. If a cambered structural member is required this can be achieved by applying the camber to the rounds 101 and 102 in the forming jig. Applying an initial set to the rounds while the adhesive cures will ensure that the pre-camber is maintained in the structural member.

The adhesive bonding material may, for example, comprise a two component epoxy material or in some applications a single phase epoxy may be used. Ideally the epoxy completely encases the fastener 110, thereby providing a barrier to corrosion of the fastener 110 along its entire length. Specifically, a suitable adhesive is a structural epoxy resin such as waterproof thixotropic solvent free epoxy resin. The adhesive bonding material provides the additional benefit of providing corrosion protection to the embedded fasteners 110.

The fasteners 110 are laced through the structural member 100 which provides for a structural member 100 which exhibits restraint to longitudinal cracking which is typical of high load failure. The precise number, type and angle of insertion of the fasteners 110 will depend on the intended application of the structural member 100.

Figure 4A:
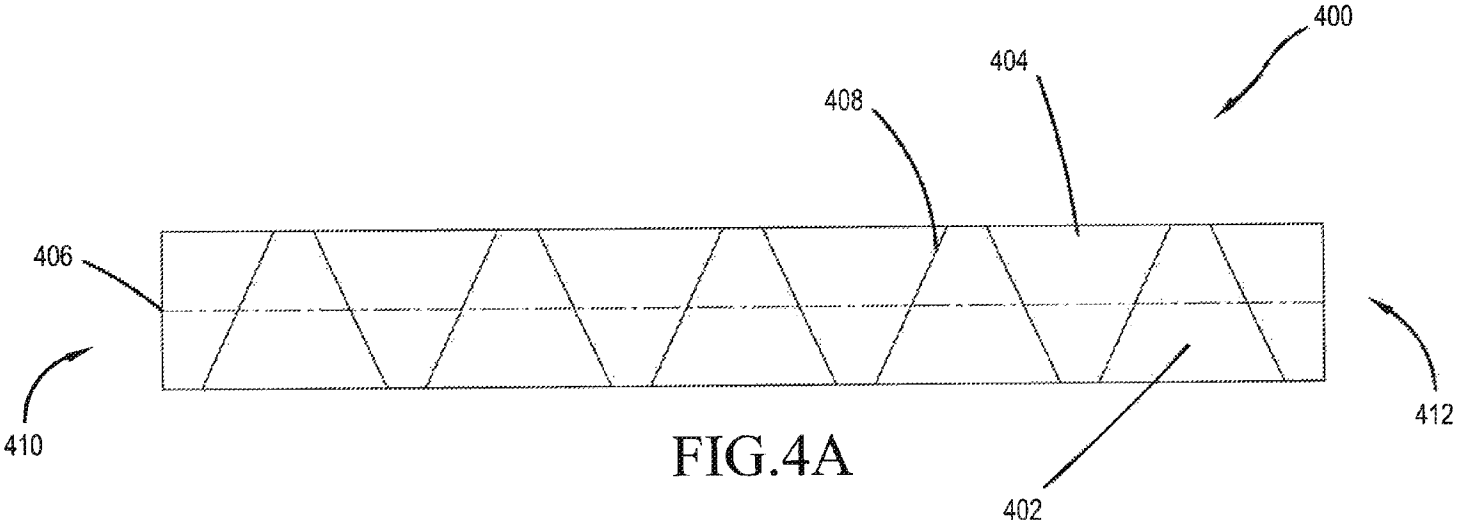
FIG. 4A shows a sectional side view of a structural member in accordance with a further embodiment of the present invention.
Figure 4B:
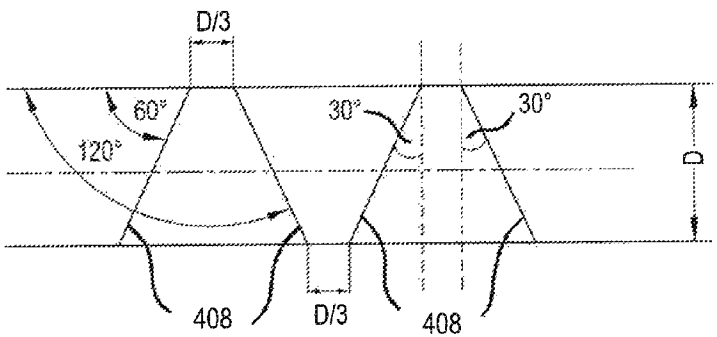
FIG. 4B shows a partial section of the structural member shown in FIG. 4A annotated with various dimensions.

FIG. 4A shows a cross-sectional side view of a structural member 400 having two flat ends 410 and 412 according to an embodiment of the invention. The structural member comprises a first timber round 402 and a second limber round 404 (equivalent to the timber rounds 101 and 102 in FIG. 1) joined along the cooperating surface 406. FIG. 4B shows a partial view of member 400 with various dimensions and angles indicated. As can be seen, adjacent holes 408 in structural member 400 have been drilled at alternating acute and obtuse angles measured in the same direction from the longitudinal axis of the member 400. As can be seen, by alternating the angles adjacent holes 408 (and, accordingly, the fasteners once secured in the holes (not shown)) are not parallel one another but are in a repeating V-type pattern. Once the fasteners are secured in place this repeating V-pattern provides a trussing effect to give the structural member 400 additional strength. A trussing effect is the ability of the dowels in their diagonal configuration to transfer imposed loads from the bearing surfaces to the outer connection nodes thus reducing the amount of stress that has to be borne by the wood fibres alone.

The precise alternating acute and obtuse angles are selected based upon load carrying characteristics of the timber and the glue bond strength developed between the dowel and the timber. For example, if alternating angles of 15° and 165° (providing each hole/fastener with an angle of 75° from the vertical) were used, very long fastener lengths would be required and a high bond strength would result. At such angles, however, specialised equipment would be required to form the required holes and the quantity of fasteners per meter would be very low leading to unacceptably high stresses on each fastener (leading to a risk of adhesive failure). Alternatively, if the fasteners were all provided at 90° (i.e. perpendicular to the longitudinal axis of the structural member) the fasteners would not provide any trussing effect and would result in very short glue bond lengths per fastener (approximately 2 diameters per pin).

Generally speaking, and as illustrated in FIG. 4, alternating angles of approximately 60° and 120° (providing each hole/fastener with an angle of 30° to the vertical) has been found to provide a suitable balance of the above considerations. However other angles of between 20° to the vertical (i.e. alternating angles of 70° to 110° to the longitudinal axis) to 45° to the vertical (i.e. alternating angles of 45° to 135° to the longitudinal axis) can also be used for certain applications In the embodiment shown in FIG. 4, the distance between the ends of adjacent fasteners 408 on the same edge of the structural member 400 is D/3 (i.e. ⅓ of the cross section D of the structural member 400). This again provides a suitable balance between competing factors. If the distance was greater than D/3 the trussing effect would be compromised or lost entirely. This could, in turn, lead to stress cracking between the pins as load is carried from pin to pin. Conversely, a separation of less than D/3 would (of course) increase the number of fasteners required which, given their expense (both in terms of the cost of the fastener itself and the adhesive required, but also the production time in forming further holes and securing the fasteners therein) would reduce the economic viability of the structural member without providing an equivalent increase in performance.

The angles of the holes and fasteners and the distance between adjacent fasteners as shown in FIG. 4 are, of course, equally applicable to the alternative embodiments of the invention described above and below.

3. End Connections

Depending on the intended application of the structural member, either one or both ends 106 of the rounds 101 and 102 of the structural member 100 may be provided with axial bores 103 and/or radial cuts 107 to facilitate connection of the structural member 100 to another member or structure.

The axial bores 103 allow for dowel type end grain connections to be made at each end of the structural member 100. The axial bores 103 are machined into the end (or ends) of the rounds 101 and 102 to a predetermined depth. Each bore 103 is dimensioned to receive a steel dowel 104 (or similar) as shown. Dowel 104 may, for example, be a deformed reinforcement bar, similar to the dowel 110 used for cross-doweling between the rounds 101 and 102.

As per insertion of the fasteners as described above, the bore 103 will generally be of slightly larger diameter than the dowel 104 to allow an adhesive bonding material to be injected and fully surround the dowel 104, thereby ensuring a high strength bonded connection between the dowel 104 and the rounds 101 or 102. The adhesive may be injected using, for example, a trigger cartridge gun or pneumatic cartridge gun.

Figure 11:
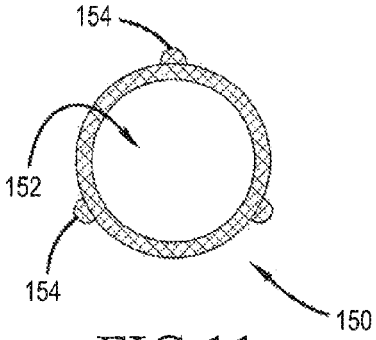
FIG. 11 shows a plan view of a centring ring for use in manufacturing the structural member according to embodiments of the present invention.
Figure 13:
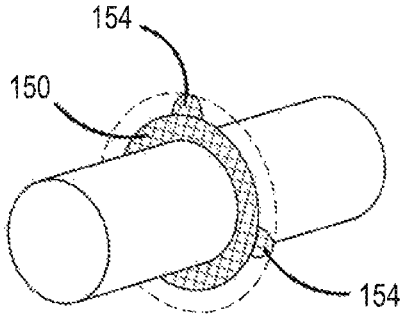
FIG. 13 is a perspective drawing showing the centering ring in use. The centering ring 150 is placed around the dowel and the lugs 154 position the dowel in borehole (dotted line), thus centering the dowel in the borehole.

To ensure that the dowel 104 is centred within the bore 103, an annular preformed centring ring 150 may be used. FIG. 11 provides a depiction of the centring ring 150 which includes a central aperture 152 having a diameter substantially the same (or slightly larger) than the dowel 104 to be used. The circumference of the centring ring is provided with a number of lugs 154 which are sized/positioned to engage with the edges of the bore 103. In use, the centring rings 150 are placed and affixed along the dowel 104 with at least one centring ring for each member that the dowel 104 will need to pass through (multiple members may be connected together, for example when connecting a rail and a post and a second rail). The dowel 104 is then inserted into the bore 103 through the central aperture 152 of the centring ring. The centring ring 150 ensures the dowel 104 is centrally located within the bore 103 and allows adhesive to be injected into the bore 103 between the edges of the bore 103 and the lugs 154. The centring ring 150 may be made from plastic, metal, or composite materials.

Figure 12:
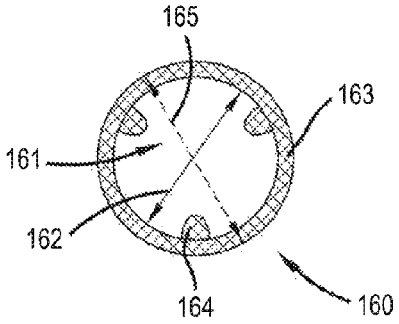
FIG. 12 shows a plan view of a washer for use in manufacturing and connecting the structural member according to embodiments of the present invention.

Referring to FIG. 12, a washer 160 can be used across the interface(s) between the structural member 100 and any other members it is attached to, thereby limiting leakage of glue into the joints between members. The washer 160 consists of an annulus 163 that has a central aperture 161, the inner diameter 162 of the annulus 163 being substantially the same as the dowel 103, and the outer diameter 165 of the annulus 163 being substantially the same as a rebate that is bored axially aligned with the bore 103. The length of the washer 160 can be between 2 and 10 mm, and the length of the rebate therefore needs to be at least sufficient to accommodate the washer 160, with the washer 160 crossing from one member, across the interface between them, into another member. The inner surface of the annulus 163 has a number of lugs 164 which are sized and positioned to hold and centre the inserted dowel 104 (or 110) in the bore 103 (or hole 109).

When connecting the structural member 100 to another member or round (or when connecting the two rounds 101 and 102 of the structural member 100 together), the process usually entails drilling the required holes in the relevant members or rounds, inserting the dowel/fastener (either with or without using a centring ring), inserting the washers across the joints, and then injecting the glue from an exposed end of a hole (for example the exposed end 113 of hole 109) through the members or rounds. Alternatively, a dowel/fastener-washer combination can be inserted simultaneously. If required, the glue may be injected with the use of a bleeder hole. Once the glue has been injected, the dowel/fastener will be encapsulated by glue. The ends of the dowels/fasteners 110 and 104 can be protected from coming into contact with the timber by using an end cap or dipping the ends of the dowel in a compound such as liquid rubber so as to create a cap with a diameter substantially that of the bore 103 or slightly less. With regard to the fasteners, the end cap may also serve to centre the fastener in the bore, in which case the centring devices as discussed above may not be required. The end caps also prevent the ends of the fasteners from being exposed to the environment and serve to smooth out/cushion the ends of the fasteners, thereby dealing with a potential breaking point.

In addition to allowing the securement of the dowels 104, the axial bores 103 also remove the central and usually weakest part of the rounds 101 and 102. This, in turn, provides enhanced strength/structural integrity to the structural member 100 as a whole.

Once the dowels 104 are secured in the structural member 100 their free ends 105 can be used to connect the structural member 100 to an additional member/structure. Load forces experienced by such a combined structure are then transmitted axially through the rounds 101 and 102 of the structural member 100. This serves to add to the strength of the combined structure.

Further, by housing the connecting dowels 104 within the rounds 101 or 102 the dowels 104 are largely protected and insulated from fire. Other known joining systems make use of connectors (e.g. dowels, pins, nails, bolts, plates etc) which are externally fitted. In the event of a fire, such externally fitted connectors have been found to transfer heat into the timber of the joist resulting in an undesirable increase in the destabilisation of joints. It is theorised this increase in destabilisation is caused by the connector becoming so hot that the timber in the hole is charred and shrinks away, thereby creating dynamic stresses in now moving members.

By providing internal dowel connectors 104 this problem is avoided, and the fire rating of the structural member 100 is dependent on the rounds 101 and 102. It is further noted that the rounds 101 and 102 used in the present invention are, in their own right, less combustible than sawn timber.

In use, it is envisaged that the free ends 105 of the dowels 104 will be inserted into a bore in the member/structure which is being secured to the structural member 100. A similar bonding arrangement to that described above is used to ensure that both ends of the dowel 104 are properly anchored in their respective bores.

By providing for connection to/with the structural member 100 by a pair of axial dowels twisting of the structural member 100 as load is applied is prevented. If required, both ends of the structural member 100 can be secured in this fashion, in which case four high strength axial dowel connections are used to secure the member 100 in position.

Where the structural member 100 is to be connected to a circular pole or the like (such as a further true round), the ends 106 of the rounds 101 and 102 may further be provided with radial cuts 107. Although the term "radial" is used it will be appreciated that the cut need not be precisely circular and could have a more general scalloped or concave shape. The radius of curvature, or the shape, of the cut 107 is selected to mirror the diameter of a circular pole or generally concave shape of another member to which the structural member 100 is to be connected. This provides for a neat and structurally sound connection with the circular pole or other member.

The radial cuts 107 may be machined into the rounds 101 and 102 using, for example, a customised large bore hole saw machine. Further, the angle of the axes of the radial cuts 107 may be selected to allow for connection with another member at any orientation. For example, the ends may be provided at a variety of angles, e.g. with the axes of the cuts 107 having a 45° angle to the axes of the rounds 101 and 102 (as shown in FIGS. 5 to 8), or the axes of the cuts 107 being at a 90° angle to the axes of the rounds 101 and 102 (as shown in FIG. 1), or any angle therebetween. This allows the structural member to be connected to a circular pole or another member at the required angle for the structure or sub-structure being constructed.

As will be appreciated, the ends selected for a particular structural member will depend on the intended use/placement of the member. For example, FIG. 1 provides a structural member 100 with radial cuts 107 at each end 106, rendering the structural member 100 suitable for connection with a rounded member/structure (e.g. a true round) at each end. FIG. 4, on the other hand, depicts a structural member 400 with two level/flat ends 410 and 412. Structural member 400 would be suitable for placement between two flat surfaces. Alternatively, the structural member 500 of FIG. 5 has one end 510 provided with radial cuts 506 and 508 (for connection with a rounded member/structure), and the opposite end 512 provided with a flat end (for connection with/securing to a flat surface).

Figure 5:
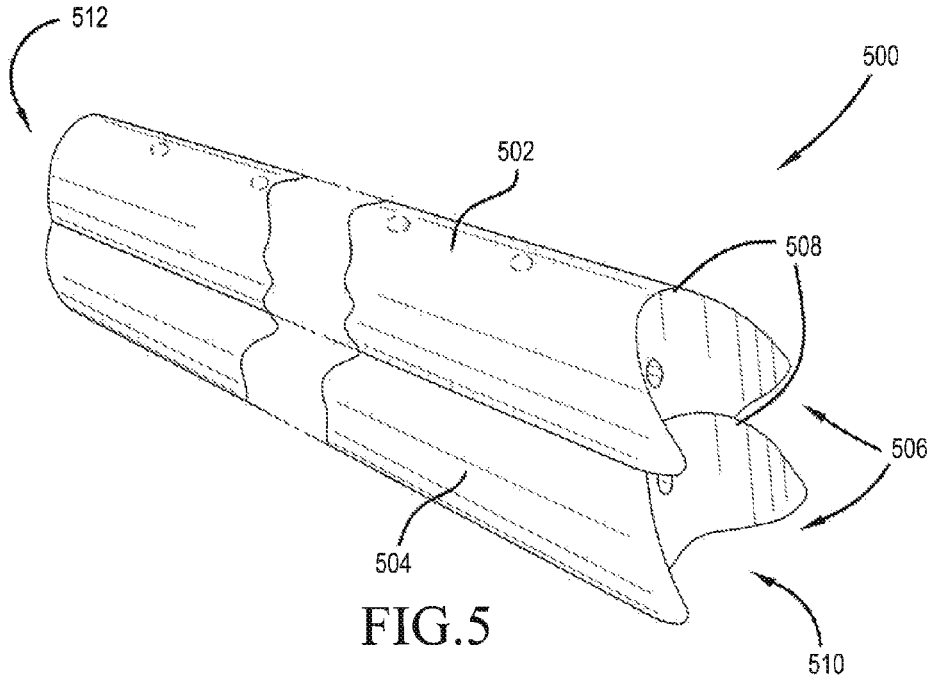
FIG. 5 shows a perspective view of a structural member in accordance with a further embodiment of the present invention.
Figure 6:
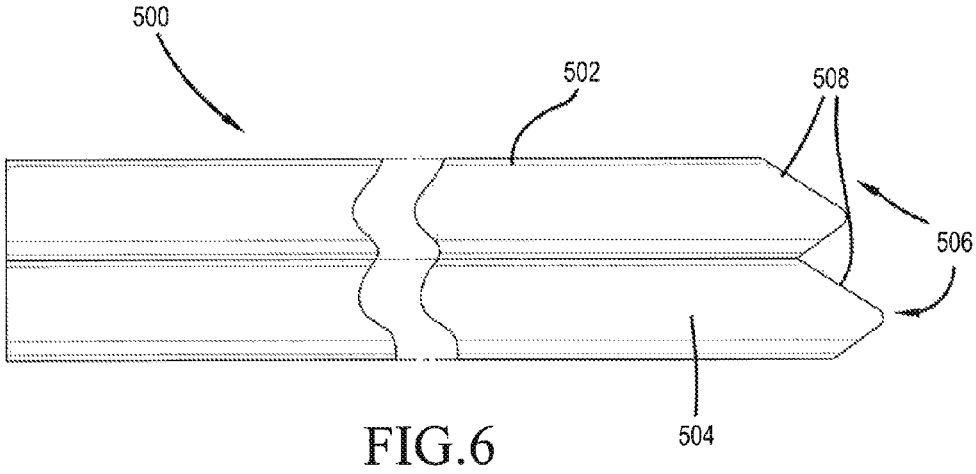
FIG. 6 shows a right side elevation of the structural member of FIG. 5.
Figure 7A:
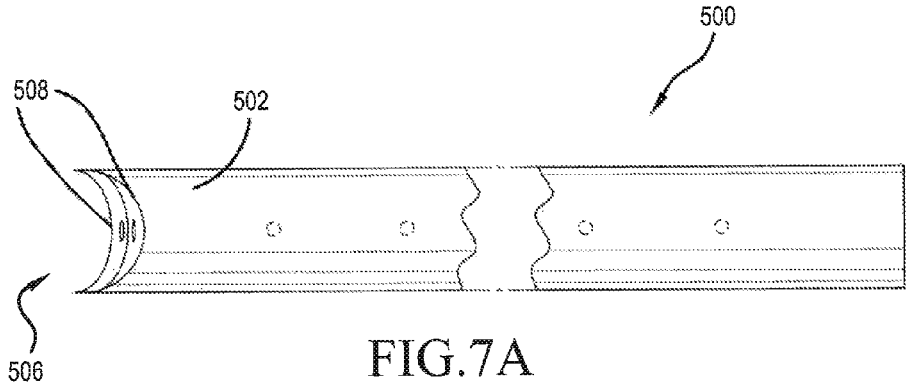
FIGS. 7A and 7B show top and bottom views respectively of the structural member of FIG. 5.
Figure 7B:
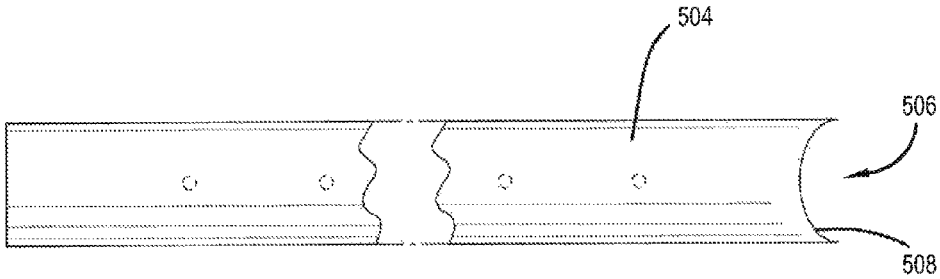

In FIG. 5, a structural member 500 is formed using a first round 502 and a second round 504. As described above, the ends of the sections 502 and 504 are machined so that the ends 506 of the rounds 502 and 504 are shaped to enable connection with another rounded section at an angle. The angled connection is facilitated by the angled axes of the radial cuts 508 of the ends 506 as shown in FIGS. 6 and 7. In the embodiment depicted, the end of the member 500 opposite the radial cuts 508 is level to allow the member 500 to be secured to a flat surface or member.

Figure 8:
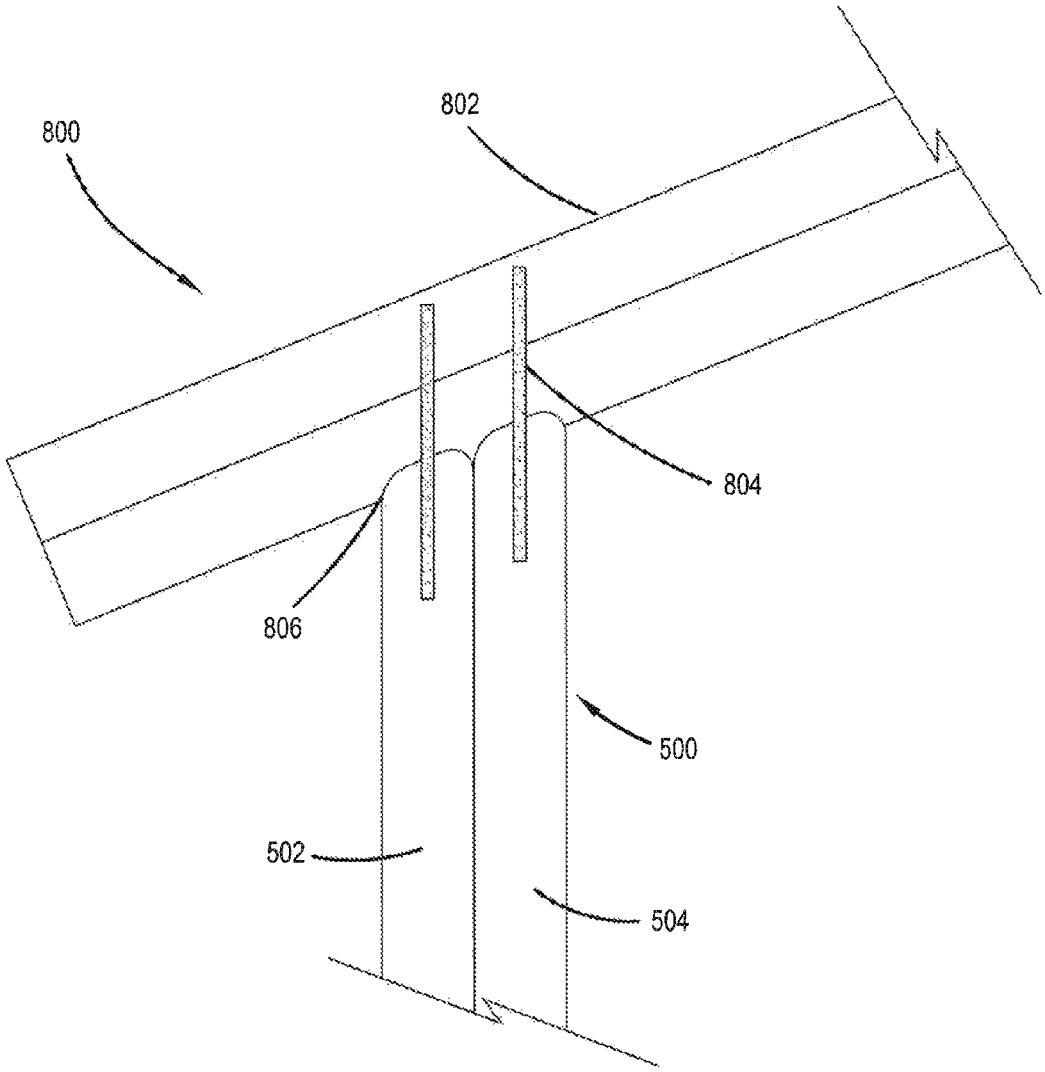
FIG. 8 shows a sectional elevation of the knee joint of a truss constructed using the structural member of FIG. 5.

Referring to FIG. 8, the member to which the structural member 500 is connected can itself be a further structural member of the type described herein. FIG. 8 shows a truss connection 800 where the structural member 500 is connected to an angled member 802 through a double pinned end-grain connection 804 with structural member 500. The joint 806 provided by the radial cuts and the axial dowels provides a superior pin jointed connection that exhibits partial moment fixity. Additionally increased bearing is achieved in comparison to square cut sawn sections.

In the embodiments shown in FIGS. 1 and 5 the two rounds (101 and 102 in FIGS. 1, and 502 and 504 in FIGS. 5 to 8) are formed with radial cuts shaped and positioned to engage with a rounded member or structure. To facilitate this the axes of the concave cuts in FIG. 1 are axially aligned.

Figure 9:
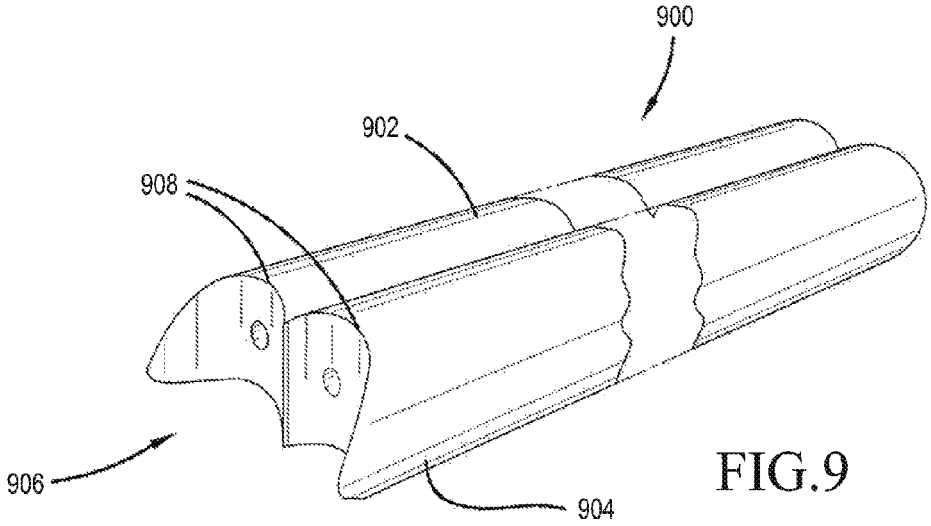
FIG. 9 shows a left side perspective view of a structural member in accordance with a still further embodiment of the present invention.
Figure 10:
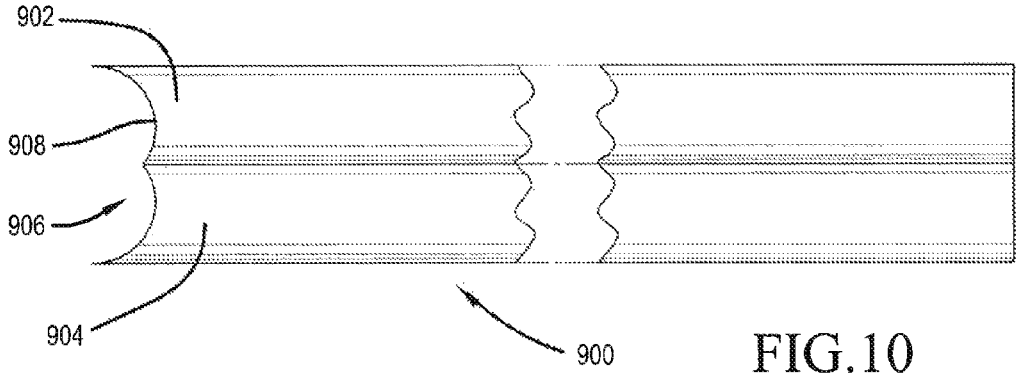
FIG. 10 shows a top view of the structural member of FIG. 9.

In an alternative embodiment, as shown in FIGS. 9 and 10, the structural member 900 consists of a first round 902 and a second round 904 having ends 906 machined so that the ends are formed from adjacent cuts 908 that have parallel, spaced apart axes. Consequently, this embodiment facilitates engagement across the width of two adjacent rounds, for example a structural member of the present invention.

The applications of the connection method described above include by way of non-limiting example: flooring systems, for example in plane connection of bearers to joists; framing systems, for example portal frame connections including a knee (column/leg to rafter), or a ridge (rafter to rafter); beam/column connections; and sloped connections (truss diagonals).

In addition to the benefits gained by use of timber rounds described above, the structural member (once assembled) acts as a composite member which serves to provide further structural strength and stability. Accordingly, forming a structural member out of timber rounds has a number of advantages, including relatively low waste, and maintaining the structural integrity of the rounds.

The capacity of the structural member as formed is comparable to equivalent sawn sections of the same size and species. However it is emphasised that the maturity of the trees used to form the structural member are many years less than that required for the equivalent sawn section.

The structural member of the present invention employs timber that is aged typically many years less than the equivalent sawn section. This allows the growth cycle of the forest to provide much younger trees for structural applications than would otherwise be possible with traditional sawn sections. Additionally, it has been suggested that juvenile trees sequester a greater volume of carbon from the atmosphere than mature trees and as such there advantages to harvesting relatively young timber (as is used in the present invention) and replanting (see, for example, The Western Australia Forest Products Commission media statement of 4 Sep. 2009).

The net wastage and the energy consumption involved in manufacturing the structural member described above is generally less than that involved in manufacturing structurally comparable sawn sections. Engineered timbers such as LVL (Laminated Veneer Lumber) have a very high environmental footprint. Despite the obvious benefit of employing small timber sections the energy involved in the high pressure forming process and the quantum of resins required to bond the members is environmentally deleterious.

4. Applications

Composite joists formed from the structural member of this invention exhibit numerous benefits over traditional single member sections. For example, the structural member provides the appropriate depth to width ratio required for use as a beam: the ratio is approximately 2 to 1, making it well suited as a bending member. The members are economically manufactured by taking advantage of low cost raw materials, typically whole log sections of cheaper softwood species.

The properties of the structural member according to the embodiments of the present invention are such that the structural member can withstand both axial compression and transverse bending without requiring any additional torsion restraints. This makes the structural member suitable, for example, for use as a beam/column. Further, the scalloped ends of the structural member facilitate a pin jointed connection with further members, which enables truss connections (at a variety of angles) using double pinned connections. Such double pinned connections are advantageous in their relative simplicity, but also provide increased bearing and exhibit partial moment fixity.

The applications for the structural member of the present invention are the same as that of any other beam or beam/column material, including typical domestic construction. The structural member is dimensionally suited to higher load applications and can effectively replace larger sawn sections in domestic construction and laminated veneer sections in commercial constructions.

The applications for the structural member include, by way of non-limiting example only, floor members such as bearers or joists, wall framing members such as lintels and heavy duty studs, roof framing members such as rafters or hanging/strutting beams, portal frame members such as columns, rafters or bottom chords, and beam/column members including piers and acoustic barrier posts.

The various elements can also be joined to form a range of connections such as truss nodes (knee and ridge connections).

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A timber structural member including:

a first timber round having a diameter of about 75 mm to about 300 mm and a first cooperating surface extending longitudinally along the length thereof, and a second timber round having a diameter of about 75 mm to about 300 mm and a second cooperating surface extending longitudinally along the length thereof, wherein the first cooperating surface is shaped to cooperate with the second cooperating surface and the two timber rounds are secured together to form a structurally integral unit in which the first cooperating surface is in contact with the second cooperating surface and the first timber round is substantially parallel to the second timber round, wherein the first cooperating surface is a flat surface provided by removing a minor segment along the length of the first timber round, and the second cooperating surface is a flat surface provided by removing a minor segment along the length of the second timber round, and wherein the first timber round is secured to the second timber round by a plurality of fasteners spaced along the length of the member, the plurality of fasteners including adjacent fasteners provided at alternating acute and obtuse angles from a longitudinal axis of the structural member, in a manner that an acute-angled fastener and an adjacent obtuse-angled fastener form a V-shape along the longitudinal axis in a sectional side view, and wherein the structural member is provided with a plurality of holes passing through the first and second rounds, each hole of the plurality of holes being shaped to receive one of the fasteners, the plurality of holes including holes formed at an acute angle to the longitudinal axis of the structural member and holes formed at an obtuse angle to the longitudinal axis of the structural member, wherein the holes formed at an acute angle include holes formed at an angle of from 45° to 70° to the longitudinal axis of the structural member, and the holes formed at an obtuse angle include holes formed at an angle of from 110° to 135° to the longitudinal axis of the structural member.

2. The timber structural member according to claim 1, wherein the holes formed at an acute angle include holes formed at an angle of 60° to the longitudinal axis of the structural member, and the holes formed at an obtuse angle include holes formed at an angle of 120° to the longitudinal axis of the structural member.

3. The timber structural member according to claim 1, wherein the fasteners are secured in the holes by an adhesive.

4. The timber structural member according to claim 3, wherein the holes are sized to allow sufficient clearance between their edges and the fasteners to allow each fastener to be encapsulated by the adhesive within the relevant hole.

5. The timber structural member according to claim 4, wherein the encapsulation of the fasteners by the adhesive prevents the fasteners from contacting the sides of the holes in which they are located.

6. The timber structural member according to claim 4, wherein the ends of the fasteners are provided with caps, the caps preventing exposure of the ends of the fasteners to the environment.

7. The timber structural member according to claim 1, wherein the fasteners are reinforcement bars.

8. The timber structural member according to claim 1, wherein an end of the first timber round is provided with a first radial cut and an end of the second timber round is provided with a second radial cut, the ends of the first and second timber rounds being adjacent one another in the timber structural member, and the radial cuts shaped and positioned to allow the timber structural member to engage with a further member, the further member having a rounded cross-section.

9. The timber structural member according to claim 8, wherein the axes of the first and second radial cuts are aligned.

10. The timber structural member according to claim 8, wherein the axes of the first and/or second radial cuts are angled to allow the timber structural member to form an angled connection with the further timber round.

11. The timber structural member according to claim 1, wherein an end of the first timber round is provided with a first axial bore sized to receive a first connecting dowel, and an end of the second timber round is provided with a second axial bore sized to receive a second connecting dowel, the ends of the first and second timber rounds being adjacent one another in the timber structural member.

12. The timber structural member according to claim 11, wherein the first connecting dowel is centrally positioned within the first bore to be coaxial with the first timber round, and the second connecting dowel is centrally positioned within the second bore to be coaxial with the second timber round.

13. The timber structural member according to claim 11, wherein the first and second connecting dowels are centred respectively in the first and second bores by centring rings, optionally the connecting dowels are selected from a group including a mild steel rod and a high strength steel rod.

14. The timber structural member according to claim 11, wherein the connecting dowels are secured in the respective bores by an adhesive, optionally the bores are sized to allow sufficient clearance between their edges and the relevant connecting dowel to allow the connecting dowel to be encapsulated by the adhesive within the relevant bore.

15. The timber structural member according to claim 1, wherein the first timber round is secured to the second timber round by use of an adhesive applied to the first and/or second cooperating surfaces.

16. The timber structural member according to claim 9, in which the axes of the first and second radial cuts are parallel.

* * * * *